US008950090B2

(12) United States Patent
Baker et al.

(10) Patent No.: US 8,950,090 B2
(45) Date of Patent: Feb. 10, 2015

(54) ARTICLE OF FOOTWEAR WITH ADJUSTABLE CLEATS

(75) Inventors: Brian D. Baker, Portland, OR (US); Elizabeth Barnes, Portland, OR (US); Jeremy L. Connell, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 253 days.

(21) Appl. No.: 13/031,771

(22) Filed: Feb. 22, 2011

(65) Prior Publication Data

US 2012/0210608 A1 Aug. 23, 2012

(51) Int. Cl.

| | |
|---|---|
| ***A43B 5/00*** | (2006.01) |
| ***A43C 15/00*** | (2006.01) |
| ***A43C 15/14*** | (2006.01) |
| ***A43C 15/16*** | (2006.01) |

(52) U.S. Cl.

CPC ..... *A43C 15/161* (2013.01); *A43C 15/14* (2013.01)

USPC ..... 36/134; 36/65; 36/67 C; 36/59 R; 36/61

(58) Field of Classification Search

CPC .. A43C 11/1493; A43C 13/04; A43C 15/066; A43C 15/068; A43C 15/09; A43C 15/12; A43C 15/16; A43C 15/005; A43C 15/04; A43C 15/06; A43C 15/063; A43C 15/065; A43B 5/001; A43B 13/26; A43B 5/02; A43B 13/141

USPC ..... 36/136, 113, 114, 115, 116, 117.3, 36/117.7, 124, 134, 59 R, 61, 62, 64, 67 R, 36/67 D, 67 C, 65

See application file for complete search history.

(56) References Cited

U.S. PATENT DOCUMENTS

| | | | | |
|---|---|---|---|---|
| 241,733 | A | | 5/1881 | Shaw |
| 303,287 | A | | 8/1884 | Hunn |
| 1,361,078 | A | * | 12/1920 | Lynn ..... 36/61 |
| 2,911,738 | A | | 11/1959 | Clerke |
| 4,271,608 | A | | 6/1981 | Tomuro |
| 4,333,249 | A | | 6/1982 | Schaefer |
| 4,375,729 | A | | 3/1983 | Buchanen, III |
| 4,445,289 | A | * | 5/1984 | Beneteau ..... 36/134 |
| 4,526,696 | A | * | 7/1985 | Delourme et al. ..... 252/61 |
| 4,644,672 | A | * | 2/1987 | Dassler et al. ..... 36/134 |

(Continued)

FOREIGN PATENT DOCUMENTS

| | | |
|---|---|---|
| DE | 3131554 | 2/1983 |
| DE | 3300330 | 7/1984 |

(Continued)

OTHER PUBLICATIONS

International Search Report and Written Opinion mailed Jul. 3, 2012 in International Application No. PCT/US2012/025854.

(Continued)

*Primary Examiner* — Clinton T Ostrup
*Assistant Examiner* — Catherine M Ferreira
(74) *Attorney, Agent, or Firm* — Plumsea Law Group, LLC

(57) ABSTRACT

An article of footwear with adjustable cleat members is disclosed. The heights of each cleat member can be adjusted independently. Each cleat member engages a cleat rotating member associated with the sole of the article. The cleat rotating member may be engaged through a hole in a top portion of a sole structure of the article of footwear. The cleat rotating member can be turned to adjust the height of the cleat member.

28 Claims, 12 Drawing Sheets

(56) References Cited

U.S. PATENT DOCUMENTS

| | | | | | |
|---|---|---|---|---|---|
| 4,715,133 | A | | 12/1987 | Hartjes et al. | |
| 4,821,434 | A | | 4/1989 | Chein | |
| 4,825,562 | A | | 5/1989 | Chuang | |
| 4,873,774 | A | | 10/1989 | Lafever | |
| 5,289,647 | A | * | 3/1994 | Mercer | 36/134 |
| 5,299,369 | A | | 4/1994 | Goldman | |
| 5,351,422 | A | | 10/1994 | Fitzgerald | |
| 5,361,518 | A | * | 11/1994 | Sussmann et al. | 36/134 |
| 5,526,589 | A | | 6/1996 | Jordan | |
| 5,557,865 | A | | 9/1996 | Sjosvard | |
| 5,628,129 | A | * | 5/1997 | Kilgore et al. | 36/134 |
| 5,638,615 | A | * | 6/1997 | Korsen | 36/134 |
| 5,732,482 | A | * | 3/1998 | Remington et al. | 36/61 |
| 5,740,619 | A | | 4/1998 | Broder | |
| 5,815,951 | A | | 10/1998 | Jordan | |
| 5,870,838 | A | * | 2/1999 | Khayat | 36/61 |
| 6,079,127 | A | | 6/2000 | Nishimura et al. | |
| 6,499,235 | B2 | * | 12/2002 | Lussier et al. | 36/126 |
| 6,647,647 | B2 | * | 11/2003 | Auger et al. | 36/134 |
| 7,254,909 | B2 | | 8/2007 | Ungari | |
| 7,430,819 | B2 | * | 10/2008 | Auger et al. | 36/134 |
| 7,490,418 | B2 | | 2/2009 | Obeydani | |
| 7,584,554 | B2 | * | 9/2009 | Fogarty et al. | 36/61 |
| 8,234,799 | B2 | * | 8/2012 | Kokavec | 36/134 |
| 8,256,145 | B2 | * | 9/2012 | Baucom et al. | 36/61 |
| 8,291,621 | B2 | * | 10/2012 | Baucom et al. | 36/134 |
| 8,453,349 | B2 | * | 6/2013 | Auger et al. | 36/59 R |
| 8,578,631 | B2 | * | 11/2013 | Francello et al. | 36/61 |
| 8,607,477 | B2 | * | 12/2013 | Åmark | 36/61 |
| 2003/0093925 | A1 | | 5/2003 | Auger et al. | |
| 2006/0130372 | A1 | | 6/2006 | Auger et al. | |
| 2006/0174518 | A1 | * | 8/2006 | Fogarty et al. | 36/61 |
| 2007/0251124 | A1 | | 11/2007 | Holbert | |
| 2007/0261271 | A1 | | 11/2007 | Krouse | |
| 2008/0066348 | A1 | | 3/2008 | O'Brien et al. | |
| 2008/0092409 | A1 | * | 4/2008 | Koo | 36/59 R |
| 2011/0167676 | A1 | * | 7/2011 | Benz et al. | 36/134 |

FOREIGN PATENT DOCUMENTS

| | | | | |
|---|---|---|---|---|
| DE | 3600525 | | 10/1987 | |
| DE | 3644812 | | 6/1988 | |
| EP | 223700 | | 5/1987 | |
| GB | 2198625 | | 6/1988 | |
| IT | EP2238849 | * | 4/2009 | A43B 5/14 |
| WO | 9314664 | | 8/1993 | |
| WO | 2009107944 | | 9/2009 | |

OTHER PUBLICATIONS

International Preliminary Report on Patentability (including Written Opinion of the ISA) mailed Sep. 6, 2013 in International Application No. PCT/US2012/025854.

* cited by examiner

ARTICLE OF FOOTWEAR WITH ADJUSTABLE CLEATS

BACKGROUND

The present invention relates generally to an article of footwear, and in particular to an article of footwear with adjustable cleats.

Articles of footwear with cleats have been previously proposed. Obeydani (U.S. Pat. No. 7,490,418) teaches footwear with manually extendable spikes. Obeydani teaches a gear assembly mounted within a heel portion. Threaded couplings are fixedly engaged with a sole portion and a plurality of spikes are each threadedly engaged with one of the threaded couplings.

Schaeffler (DE Patent Number 3644812) teaches a shoe heel with moveable spike nails. Schaeffler teaches a heelpiece with a reinforcement plate on which a nail plate rests. The nail plate includes spike nails, which project from openings in the heelpiece. A compression spring rests on the nail plate to urge the nail plate downwards. Schaeffler teaches that in some situations the spike nails are pressed back into the heelpiece interior. Schaeffler also teaches a screw that can be used to lock the nail plate at a height at which the spike tops are fixed above the exit height.

Sjosvard (U.S. Pat. No. 5,557,856) teaches an anti-skid device for footwear. Sjosvard teaches an anti-skid device with sliding members connected to spikes. An electric motor is configured to operate a gear mechanism to move the spikes between retracted and extended positions. Sjosvard also teaches sensing means and activating means for manually activating the electric motor.

SUMMARY

In one aspect, an article of footwear includes a sole structure including a top portion and a bottom portion disposed distally from the top portion, a cleat rotating member disposed within the sole structure and a cleat member including an extending portion that engages the cleat rotating member. The cleat rotating member can be turned to adjust a height of the cleat member with respect to the bottom portion. Also, the cleat rotating member is accessible through a hole on the top portion of the sole structure.

In another aspect, an article of footwear includes an upper including an interior cavity for receiving a foot and a sole structure including a top portion and a bottom portion disposed distally from the top portion. The top portion is associated with the interior cavity of the upper. The sole structure includes a first cleat member having an adjustable height, the first cleat member extending from the bottom portion. The sole structure includes a second cleat member having an adjustable height, the second cleat member extending from the bottom portion. The height of the first cleat member and the height of the second cleat member can be adjusted substantially independently. The height of the first cleat member is adjustable from within the interior cavity and where the height of the second cleat member is adjustable from within the interior cavity.

In another aspect, an article of footwear includes a sole structure including a top portion and a bottom portion disposed distally from the top portion. The article also includes a cleat rotating member disposed within the sole structure. The article also includes a cleat member including an outer cleat portion and an extending portion, where the extending portion is configured to engage the cleat rotating member. The article also includes a washer member disposed between the cleat rotating member and the cleat member, where the washer member includes a rib. The outer cleat portion of the cleat member includes a notch that receives the rib of the washer member. The rotating member can be turned to adjust a height of the cleat member with respect to the bottom portion and the rotating member is accessible through a hole on the top portion of the sole structure.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
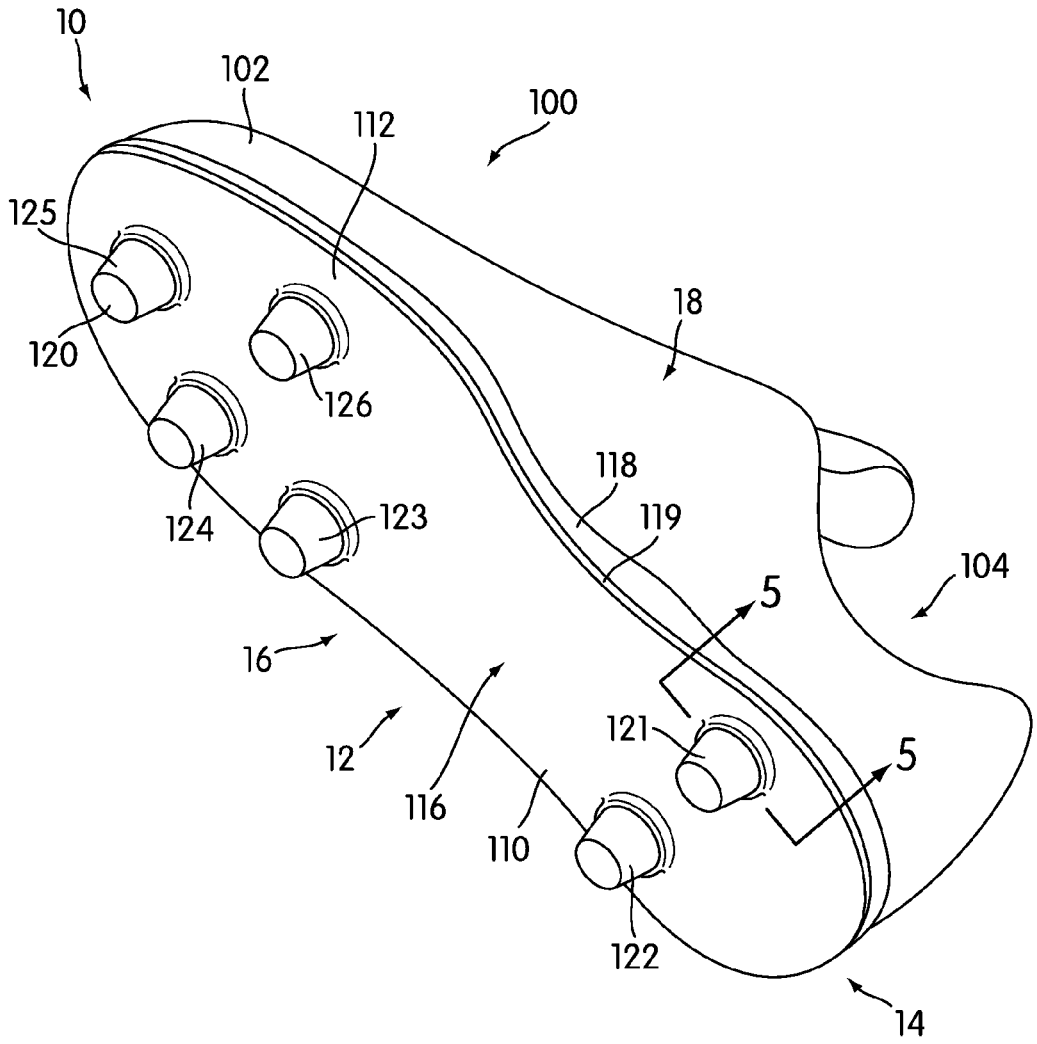
FIG. 1 is an isometric view of an embodiment of an article of footwear with a plurality of cleat members.
Figure 2:
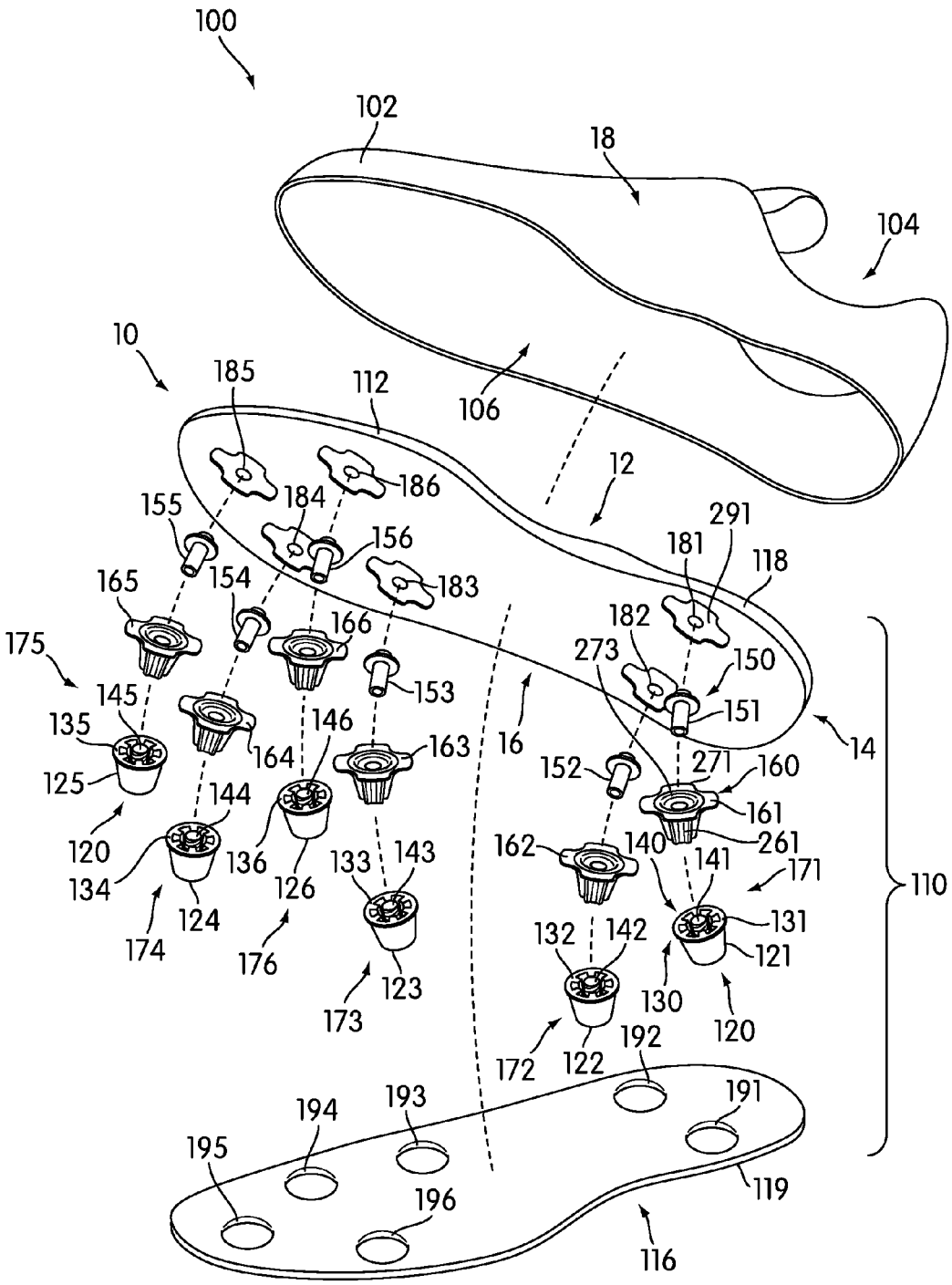
FIG. 2 is an exploded isometric view of an embodiment of an article of footwear with a plurality of cleat members.

FIGS. 1 and 2 illustrate views of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 and 2, article of footwear 100, also referred to simply as article 100, is intended to be used with a right foot; however, it should be understood that the following description may equally apply to a mirror image of article of footwear 100 that is intended for use with a left foot.

Referring to FIGS. 1 and 2, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "distal" as used throughout this detailed description and in the claims refers to a direction directed away from a foot, while the term "proximal" as used throughout this detailed description and in the claims refers to a direction directed towards the foot. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Upper 102 can include entry hole 104. Entry hole 104 may provide access to interior cavity 106 of article of footwear 100 that is configured to receive a foot. Moreover, in some cases, article of footwear 100 may include a lacing system of some kind for adjusting the size of interior cavity 106 in order to secure upper 102 to a foot.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 can include top portion 114 (see FIG. 8) and bottom portion 116. Bottom portion 116 may be disposed distally from top portion 114. In some cases, top portion 114 may be disposed adjacent to upper 102, while bottom portion 116 may be oriented towards a ground surface. In some cases, top portion 114 may be accessible from within interior cavity 106 of article of footwear 100.

In some embodiments, sole structure 110 may comprise one or more layers. In some cases, sole structure 110 may comprise a single layer. In other cases, sole structure 110 may comprise two or more layers. In an exemplary embodiment, sole structure 110 comprises first layer 118 and second layer 119. Second layer 119 may be disposed distally to first layer 118. In still other embodiments, sole structure 110 could comprise three or more layers.

In some cases, first layer 118 and second layer 119 may be substantially rigid layers. In other cases, first layer 118 may be more rigid than second layer 119. In some cases, for example, first layer 118 may be a rigid layer that provides rigid support for article of footwear 100, while second layer 119 may be a partially deformable layer. In still other cases, first layer 118 and second later 119 can have any other material properties.

In some embodiments, sole structure 110 may include provisions for increasing traction with a ground surface such as natural grass, synthetic grass or other surfaces. In some cases, sole structure 110 may include cleat members to enhance traction with the ground. Generally, the term "cleat members" as used in this detailed description and throughout the claims includes any provisions disposed on a sole to increase traction through friction or penetration of a ground surface. Cleat members may be configured for football, soccer, baseball or any type of activity that requires traction.

In one embodiment, sole structure 110 may include plurality of cleat members 120. In different embodiments, the number of cleat members associated with plurality of cleat members 120 can vary. In some cases, plurality of cleat members 120 can include two or more cleat members. In other cases, plurality of cleat members 120 can include between 2 and 20 cleat members. In still other cases, plurality of cleat members 120 can include more than 20 cleat members. In an exemplary embodiment, plurality of cleat members 120 can include six cleat members. In particular, in the current embodiment, plurality of cleat members 120 includes first cleat member 121, second cleat member 122, third cleat member 123, fourth cleat member 124, fifth cleat member 125 and sixth cleat member 126.

In different embodiments, the arrangements of cleat members on sole structure 110 can vary. In some cases, cleat members can be disposed in forefoot portion 10 of sole structure 110. In other cases, cleat members can be disposed in midfoot portion 12 of sole structure 110. In still other cases, cleat members can be disposed in heel portion 14 of sole structure 110. Moreover, in some cases, cleat members can be disposed in any combination of forefoot portion 10, midfoot portion 12 and heel portion 14. Furthermore, cleat members can be disposed on an outer peripheral portion and/or a central portion of sole structure 110. In an exemplary embodiment, plurality of cleat members 120 may include four cleat members disposed in forefoot portion 10 and two cleat members disposed in heel portion 14. Furthermore, in the current embodiment, each cleat of plurality of cleats 120 may be disposed in outer peripheral portion 112 of sole structure 110.

In some embodiments, each cleat member of plurality of cleat members 120 may comprise an outer cleat portion and a extending portion that is used to secure the cleat member to sole structure 110. For example, in the current embodiment, first cleat member 121 may include first outer cleat portion 131 and first extending portion 141. First outer cleat portion 131 may be a ground engaging portion that is configured to penetrate into, or otherwise provide traction with, a ground surface such as natural or artificial grass. First extending portion 141 may be attached to first outer cleat portion 131 and may include means for fastening first cleat member 121 to sole structure 110.

In a similar manner, each of the remaining cleats of plurality of cleat members 120 may include outer cleat portions and extending portions. In the current embodiment, article of footwear 100 may include second outer cleat portion 132, third outer cleat portion 133, fourth outer cleat portion 134, fifth outer cleat portion 135 and sixth outer cleat portion 136 associated with second cleat member 122, third cleat member 123, fourth cleat member 124, fifth cleat member 125 and sixth cleat member 126, respectively. These outer cleat portions are referred to collectively as plurality of outer cleat portions 130. In addition, in the current embodiment, article of footwear 100 may include second extending portion 142, third extending portion 143, fourth extending portion 144, fifth extending portion 145 and sixth extending portion 146 associated with second cleat member 122, third cleat member 123, fourth cleat member 124, fifth cleat member 125 and sixth cleat member 126, respectively. These extending portions are referred to collectively as plurality of extending portions 140.

In the current embodiment, plurality of extending portions 140 may comprise bolt or screw-like fasteners. In particular, each extending portion of plurality of extending portions 140 may comprise a threaded bolt that extends through a central axis of each cleat member of plurality of cleat members 120. In other embodiments, however, any other kinds of fasteners could be used. In particular, the embodiments may not be restricted to use with threaded fasteners.

An article of footwear can include provisions for tuning the traction properties of a sole structure. In some cases, an article of footwear can include provisions for adjusting properties of one or more cleat members. In an exemplary embodiment, an article of footwear can include provisions for adjusting the height of one or more cleat members.

In some embodiments, article of footwear 100 can include one or more cleat rotating members for adjustably fastening plurality of cleat members 120. For example, in the current embodiment, article of footwear 100 may include first cleat rotating member 151 for fastening first cleat member 121. First cleat rotating member 151 may comprise an approximately cylindrical geometry that is configured to adjustably fasten first extending portion 141 of first cleat member 121. In particular, the threading within first cleat rotating member 151 may engage threading of first extending portion 141. In a substantially similar manner, article of footwear 100 can include second cleat rotating member 152, third cleat rotating member 153, fourth cleat rotating member 154, fifth cleat rotating member 155 and sixth cleat rotating member 156 for adjustably receiving second extending portion 142, third extending portion 143, fourth extending portion 144, fifth extending portion 145 and sixth extending portion 146 of plurality of extending portions 140, respectively.

In some embodiments, article of footwear 100 can also include first washer member 161 that is configured to insert between first outer cleat portion 131 and first cleat rotating member 151, when first cleat member 121 is engaged with first cleat rotating member 151. First washer member 161 may help fill in gaps or spacing between first outer cleat portion 131 and first cleat rotating member 151 to prevent debris from collecting between first outer cleat portion 131 and first cleat rotating member 151.

Figure 3:
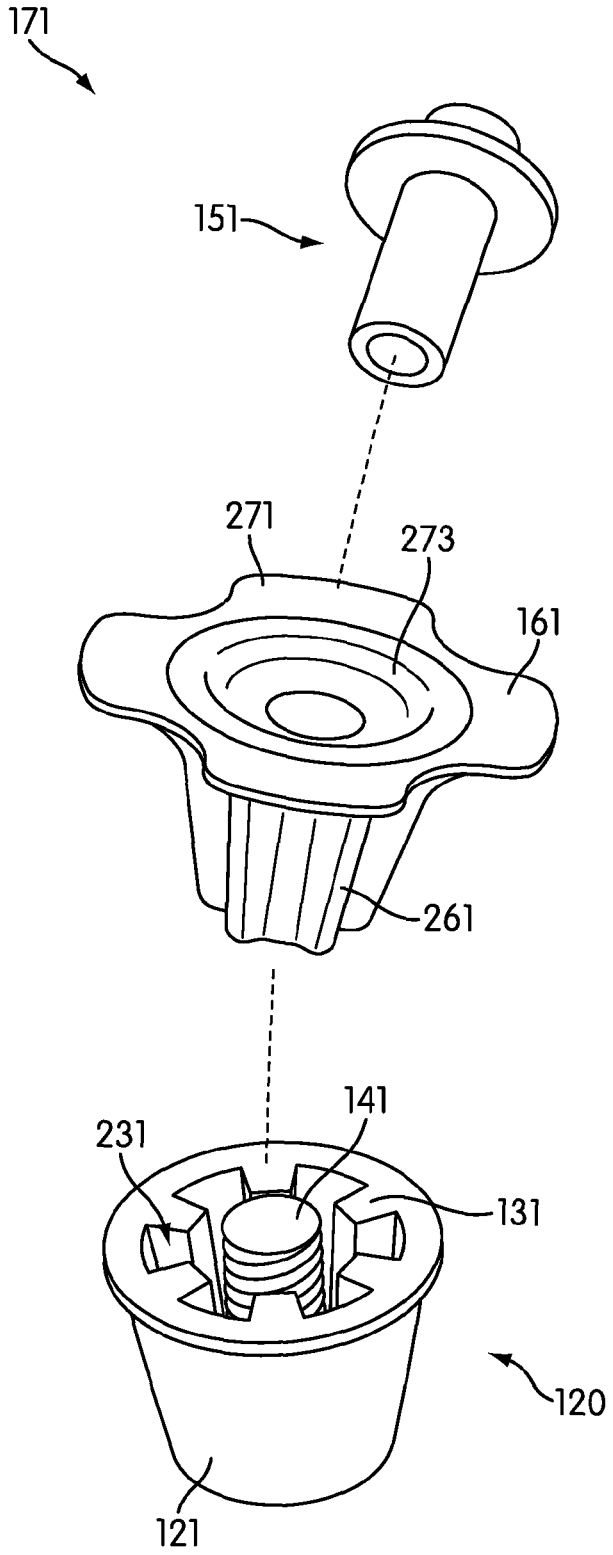
FIG. 3 is an enlarged exploded isometric view of components of a cleat assembly.

Referring now to FIGS. 2 and 3, in different embodiments, the geometry of first washer member 161 may vary. In some embodiments, first washer member 161 could include provisions for engaging with first cleat member 121. In some cases, for example, first washer 161 may include ribs 261. In some embodiments, ribs 261 may engage with notches 231 of first cleat member 121. This arrangement may help prevent rotation of first washer member 161 within first cleat member 121.

In some embodiments, first washer member 161 may also include flange portion 271. In some cases, flange portion 271 may extend outwardly from base portion 273 of first washer member 161. In some embodiments, flange portion 271 may have a clover shape. In other embodiments, flange portion 271 could have any other shape including, but not limited to: a rectangular shape, a rounded shape, a triangular shape, a polygonal shape, a regular shape, an irregular shape as well as any other kind of shape. Moreover, in some cases flange portion 271 can be configured to engage with recessed portion 291 of first layer 118. In particular, recessed portion 291 may have a shape that corresponds to the shape of flange portion 271 of first washer member 161. This configuration for first washer member 161 may help to disperse shearing stress. Moreover, this interlocking configuration between first washer member 161 and first cleat member 121 helps prevent rotation of first cleat member 121, since first washer member 161 is prevented from rotating by way of engagement in recessed portion 291.

In a similar manner, article of footwear 100 can include second washer member 162, third washer member 163, fourth washer member 164, fifth washer member 165 and sixth washer member 166 associated with second cleat member 122, third cleat member 123, fourth cleat member 124, fifth cleat member 125 and sixth cleat member 126, respectively. These washer members may be referred to collectively as plurality of washer members 160. Moreover, each of plurality of washer members 160 may be provided with substantially similar geometries to first washer member 161 including ribs and non-circular flange portions that help prevent shearing stress and rotation of the respective cleat members.

For purposes of clarity, first cleat member 121, first cleat rotating member 151 and first washer member 161 may be collectively referred to as first cleat assembly 171. In a similar manner, second cleat assembly 172, third cleat assembly 173, fourth cleat assembly 174, fifth cleat assembly 175 and sixth cleat assembly 176 may comprise corresponding components from plurality of cleat members 120, plurality of cleat rotating members 150 and plurality of washer members 160. For example, second cleat assembly 172 comprises second cleat member 122, second cleat rotating member 152 and second washer member 162. Likewise, fifth cleat assembly 175 comprises fifth cleat member 125, fifth cleat rotating member 155 and fifth washer member 165.

Sole structure 110 can include provisions for receiving various components of a cleat assembly. In the current embodiment, first layer 118 of sole structure 110 includes first hole 181, second hole 182, third hole 183, fourth hole 184, fifth hole 185 and sixth hole 186 for receiving portions of first cleat rotating member 151, second cleat rotating member 152, third cleat rotating member 153, fourth cleat rotating member 154, fifth cleat rotating member 155 and sixth cleat rotating member 156, respectively. In addition, in the current embodiment, second layer 119 of sole structure 110 includes first wide hole 191, second wide hole 192, third wide hole 193, fourth wide hole 194, fifth wide hole 195 and sixth wide hole 196 for receiving portions of first cleat member 121, second cleat member 122, third cleat member 123, fourth cleat member 124, fifth cleat member 125 and sixth cleat member 126, respectively. With this arrangement, first cleat assembly 171, second cleat assembly 172, third cleat assembly 173, fourth cleat assembly 174, fifth cleat assembly 175 and sixth cleat assembly 176 may be attached to sole structure 110 in a manner that allows for the adjustment of plurality of cleat members 120.

Figure 4:
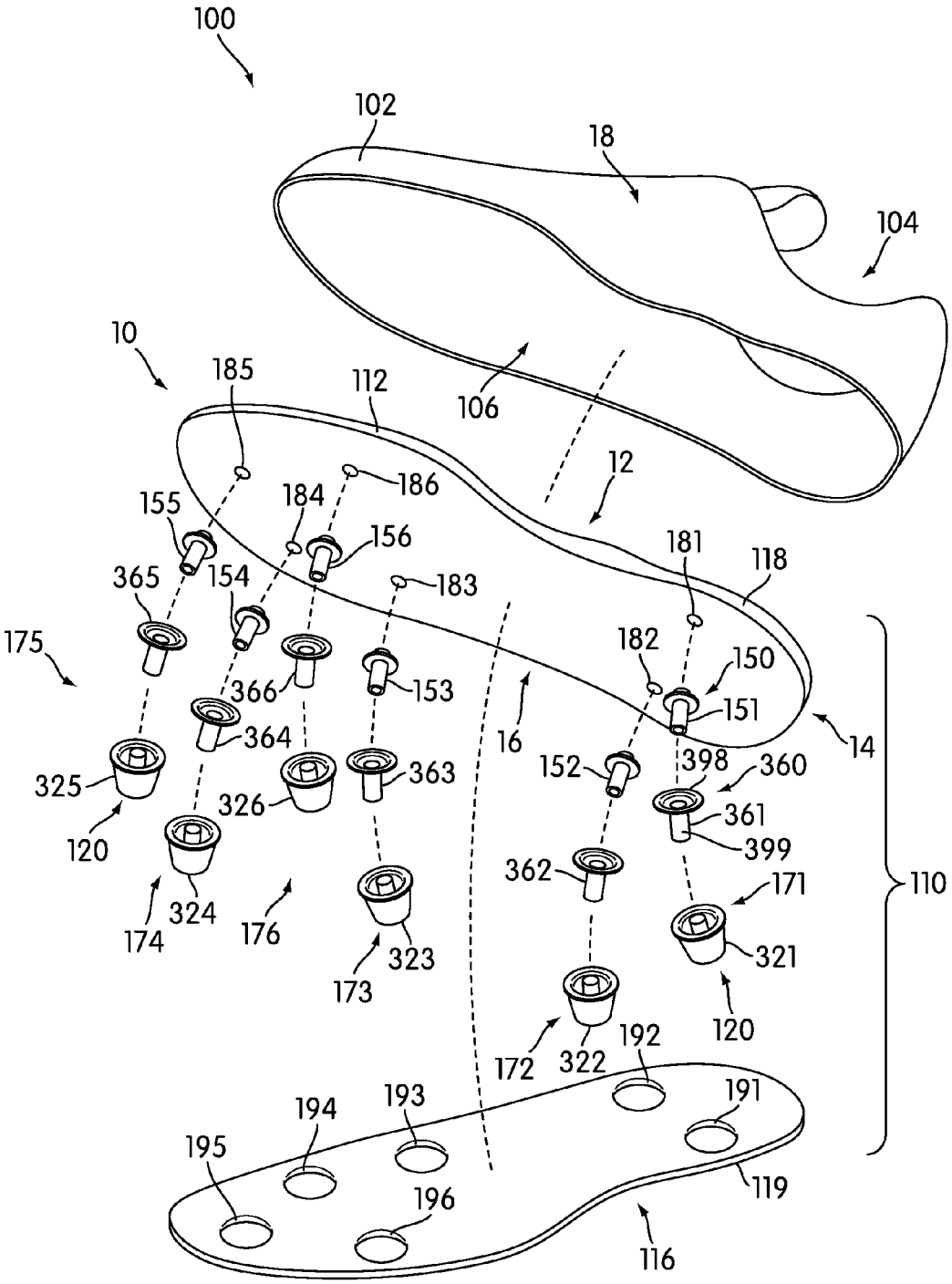
FIG. 4 is an exploded isometric view of another embodiment of an article of footwear with an exemplary cleat member.

In other embodiments, the geometries of one or more components of a cleat assembly may vary. For example, FIG. 4 illustrates an isometric exploded view of an alternative embodiment for article of footwear 100, in which the geometry of the washer members are varied from those shown in FIG. 2. For purposes of clarity, like numbers are used for similar components.

Referring to FIG. 4, article of footwear 100 includes first washer member 361, second washer member 362, third washer member 363, fourth washer member 364, fifth washer member 365 and sixth washer member 366 (referred to collectively as cleat assembly 360), which correspond to first cleat assembly 171, second cleat assembly 172, third cleat assembly 173, fourth cleat assembly 174, fifth cleat assembly 175 and sixth cleat assembly 176, respectively. In some embodiments, first washer member 361 may have an approximately rounded geometry. Also, in some cases, base portion 399 of first washer member 361 may be substantially smooth and without any ribs. Moreover, first washer member 361 may include flange portion 398, which is substantially rounded. In some embodiments, each of second washer member 362, third washer member 363, fourth washer member 364, fifth washer member 365 and sixth washer member 366 may have substantially similar geometries to first washer member 361. However, it will be understood that in other embodiments, each washer member could have any other geometry.

Additionally, in this alternative embodiment, article of footwear 100 includes first cleat member 321, second cleat member 322, third cleat member 323, fourth cleat member 324, fifth cleat member 325 and sixth cleat member 326. In embodiments where each washer member may be substantially rounded, each of first cleat member 321, second cleat member 322, third cleat member 323, fourth cleat member 324, fifth cleat member 325 and sixth cleat member 326 may be configured with geometries to smoothly engage with corresponding washer members. For example, in contrast to the previous embodiment, the cleat members may not include any notches.

Figure 5:
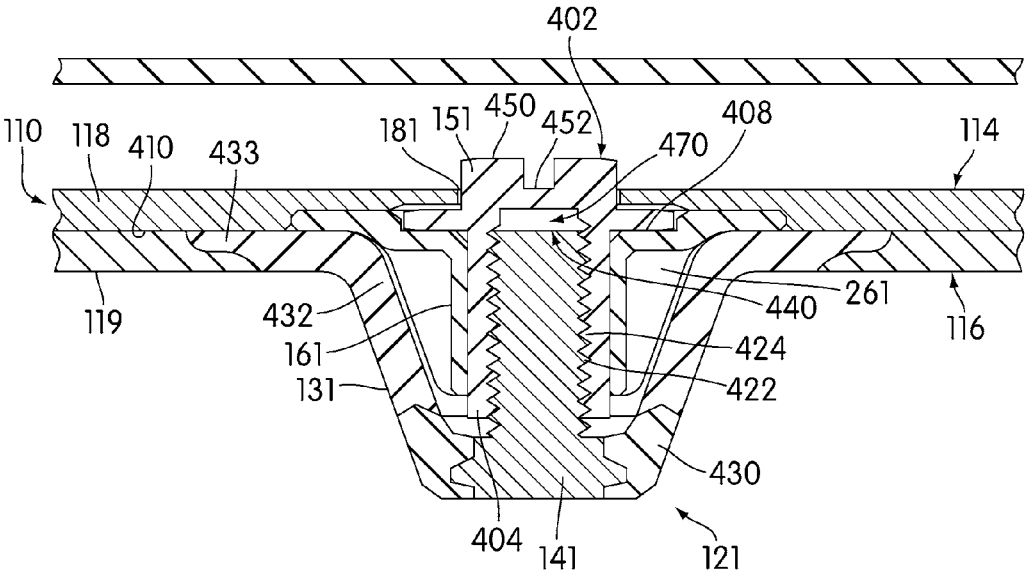
FIG. 5 is an enlarged cross-sectional view of a cleat assembly for an article of footwear according to article FIG. 1.

FIG. 5 illustrates a cross-sectional view of an embodiment of first cleat assembly 171. Although only first cleat assembly 171 is shown in cross-section in the Figures, it should be understood that the arrangement discussed here for first cleat assembly 171 may be substantially similar to the arrangements of second cleat assembly 172, third cleat assembly 173, fourth cleat assembly 174, fifth cleat assembly 175 and sixth cleat assembly 176.

Referring to FIG. 5, first cleat rotating member 151 may be attached to first layer 118 of sole structure 110. First cleat rotating member 151 may include first end portion 402 and second end portion 404. First end portion 402 may be inserted through first hole 181 of first layer 118 so that first end portion 402 extends outwardly from top portion 114 of sole structure 110. Second end portion 404 may extend outwardly from bottom portion 116 of sole structure 110. In addition, first cleat rotating member 151 can include flange portion 408 that is disposed between first washer member 161 and lower surface 410 of first layer 118. In some embodiments, first cleat rotating member 151 is not fixedly attached to either first layer 118 or first washer member 161. Instead, first cleat rotating member 151 may be capable of rotating with respect to sole structure 110.

First washer member 161 may extend around first cleat rotating member 151. In some cases, portions of first washer member 161 may extend beyond flange portion 408 and extend to lower surface 410 of first layer 118. As previously discussed, first extending portion 141 of first cleat member 121 may be inserted into central bore 470 of first cleat rotating member 151. In some cases, first threading 422 of first extending portion 141 may engage second threading 424 of central bore 470.

In some embodiments, first outer cleat portion 131 may comprise distal portion 430 and proximal portion 432. Distal portion 430 is disposed distally from proximal portion 432 and forms the tip of first cleat member 121. Proximal portion 432 is disposed adjacent to bottom portion 116 of sole structure 110.

In some embodiments, a portion of first cleat member 121 may be disposed between first layer 118 and second layer 119 of sole structure 110. In the current embodiment, proximal portion 432 includes outer peripheral portion 433. Outer peripheral portion 433 extends outwardly from the base of proximal portion 432. In some cases, outer peripheral portion 433 may be disposed between first layer 118 and second layer 119 of sole structure 110. This arrangement helps to prevent debris from settling between proximal portion 432 and sole structure 110, especially as the height of first cleat member 121 is adjusted. Furthermore, using this configuration, first washer member 161 and second end portion 404 of first rotating cleat member 151 are covered by first outer cleat portion 131.

In different embodiments, the geometry of first outer cleat portion 131 can vary. In some embodiments, first outer cleat portion 131 may have an approximately truncated conical geometry. In particular, the width of outer cleat portion 131 may widen from distal portion 430 to proximal portion 432. In other cases, however, first outer cleat portion 131 can have any other geometry.

In some embodiments, distal portion 430 and proximal portion 432 can have substantially different material properties. For example, in one embodiment, distal portion 430 may comprise a substantially rigid material and proximal portion 432 may comprise a relatively flexible material. In the current embodiment, first extending portion 141 comprises a rigid bolt that extends through a center of distal portion 430. In addition, outer peripheral portion 433 of distal portion 430 may comprise a substantially rigid material. This arrangement provides for increased strength at the ground engaging portion of first cleat member 121. In some cases, proximal portion 432 may comprise a relatively flexible portion. This arrangement allows for some flexibility of proximal portion 432 as the position of first cleat member 121 is adjusted.

In some embodiments, first cleat rotating member 151 can include provisions for being rotated by an external device, such as a driver of some kind. In some embodiments, first cleat rotating member 151 may include drive receiving surface 450 disposed on first end portion 402 of first cleat rotating member 151. Drive receiving surface 450 may include recess 452 for receiving a fastening device of some kind. Examples of fastening devices include, but are not limited to: screw drivers, flexible shaft screw drivers, right angle screw drivers, hex keys, drills, ratchets, wrenches as well as any other devices for engaging fasters. In an exemplary embodiment, recess 452 may be configured to receive a screw driver of some kind. This arrangement allows a user to fasten first cleat member 121 by engaging recess 452. An example of such fastening is described in detail below.

As previously discussed, the configurations for second cleat assembly 172, third cleat assembly 173, fourth cleat assembly 174, fifth cleat assembly 175 and sixth cleat assembly 176 may be substantially similar to the configuration shown and discussed for first cleat assembly 171. This arrangement allows a user to adjust the heights of plurality of cleat members 120 by rotating the cleat rotating member corresponding to a particular cleat member. Furthermore, this configuration provides a method for independent adjustment of the heights of each cleat member of plurality of cleat members 120.

Figure 6:
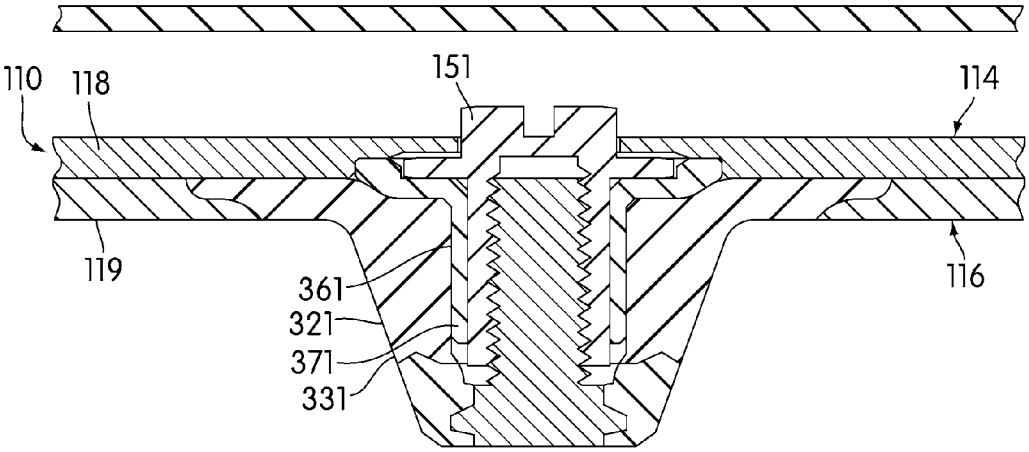
FIG. 6 is an enlarged cross-sectional view of a cleat assembly for an article of footwear according to FIG. 4.

FIG. 6 illustrates a cross-sectional view of an embodiment of the first cleat assembly 171 representative of FIG. 4. It should be understood that the arrangement discussed for first cleat assembly 171 may be substantially similar to the arrangements of second cleat assembly 172, third cleat assembly 173, fourth cleat assembly 174, fifth cleat assembly 175 and sixth cleat assembly 176. In one embodiment, first washer member 361 may be substantially thin at base portion 371. Accordingly, first outer cleat portion 331 may be thicker in order to fill in any space between first washer member 361 and first outer cleat portion 331.

Figure 7:
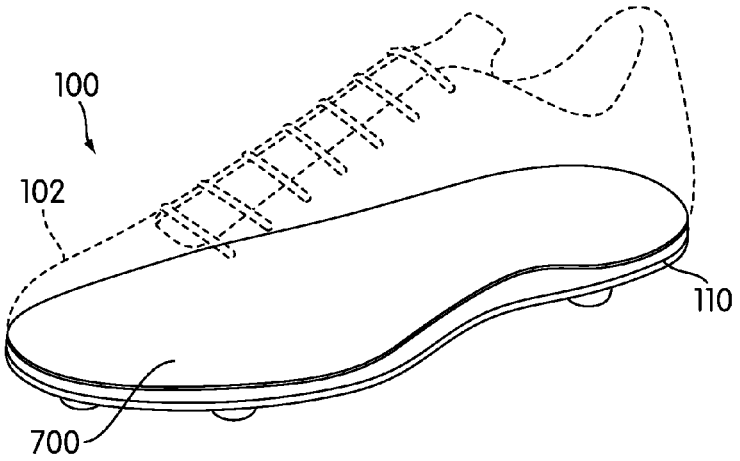
FIG. 7 is an isometric view of an embodiment of an article of footwear with an insert covering a top portion of a sole structure.
Figure 8:
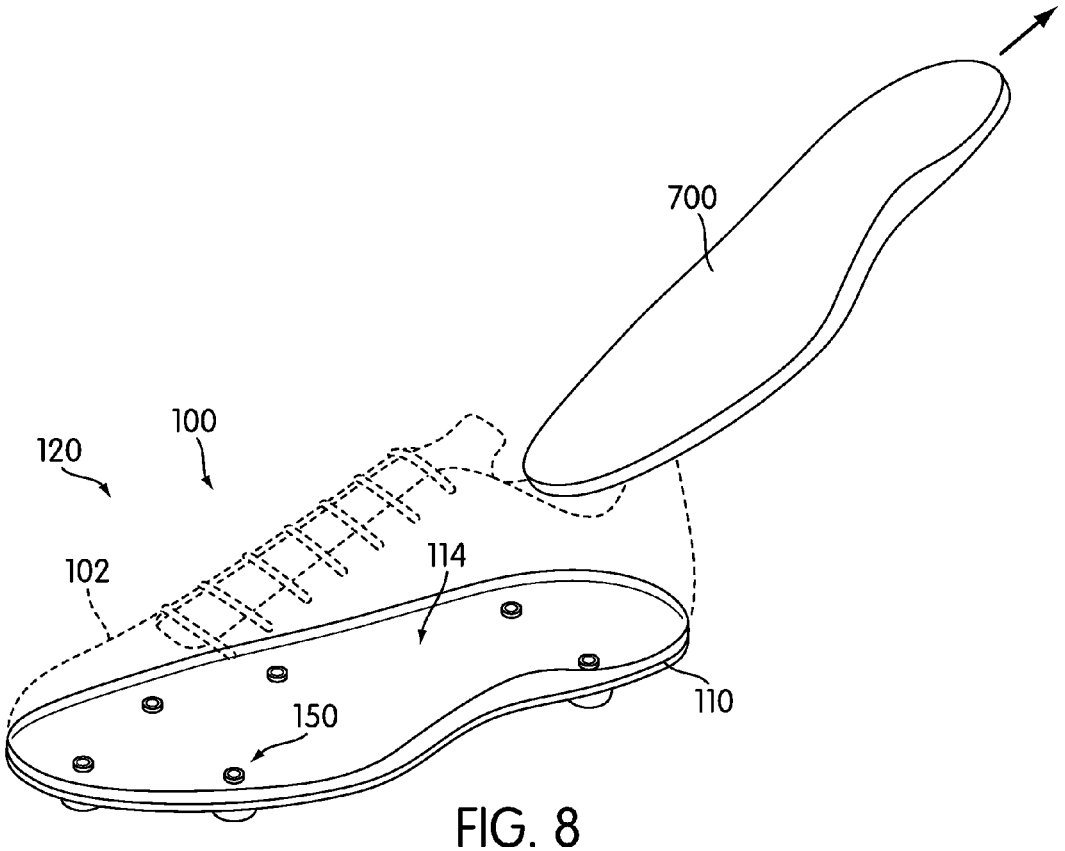
FIG. 8 is an isometric view of an embodiment of an article of footwear with an insert being removed to expose a top portion of a sole structure.

FIGS. 7 through 8 illustrate isometric views of an embodiment of article of footwear 100. For purposes of clarity, upper 102 is shown in phantom. In some embodiments, top portion 114 of sole structure 110 may be covered by an insert of some kind to hide the exposed portions of plurality of cleat rotating members 150. For example, in the current embodiment, insert 700 is used to cover top portion 114. This arrangement prevents discomfort that may occur if the foot of a user comes into direct contact with plurality of cleat rotating members 150. Any type of insert could be used including an insole or a liner of some kind.

Referring now to FIG. 8, a user may remove insert 700 to gain access to top portion 114 of sole structure 110. In particular, once insert 700 has been removed, plurality of cleat rotating members 150 may be exposed on top portion 114. With plurality of cleat rotating members 150 exposed on top portion 114 of sole structure 110, a user may adjust the heights of each cleat member of plurality of cleat members 120 by inserting a fastening device into each of plurality of cleat rotating members 150 in the manner described below.

Figure 9:
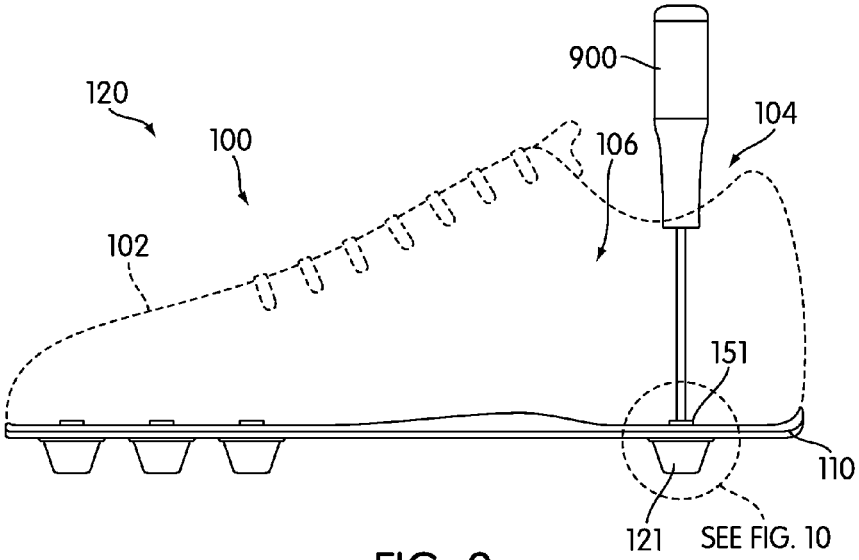
FIG. 9 is side view of an embodiment of an article of footwear with a cleat member being adjusted.
Figure 10:
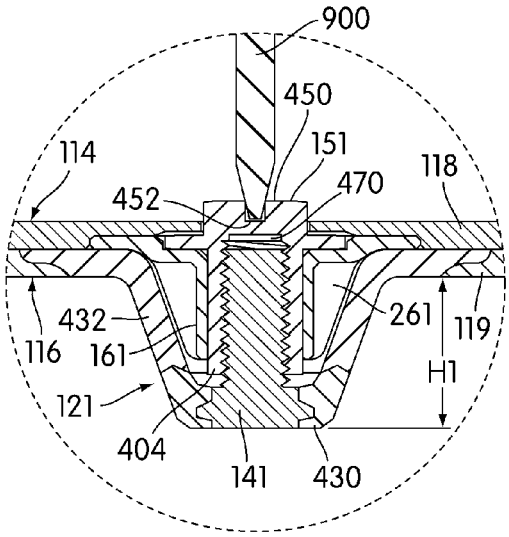
FIG. 10 is an enlarged cross-sectional view of an embodiment of a cleat assembly.
Figure 11:
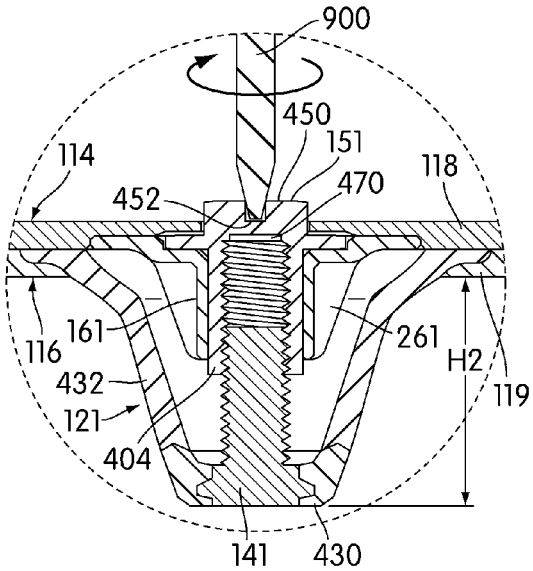
FIG. 11 is an enlarged cross-sectional view of an embodiment of a cleat assembly with a height of a cleat member being adjusted.

Referring to FIGS. 9 through 11, a user may adjust the height of first cleat member 121 by inserting screw driver 900 into interior cavity 106 of upper 102. Specifically, screw driver 900 may be engaged with recess 452 of drive receiving surface 450 of first cleat rotating member 151. By turning first cleat rotating member 151 using screw driver 900, first cleat member 121 may extend outwardly from first cleat rotating member 151. In particular, since first cleat member 121 is prevented from rotating (due to the attachment to first layer 118 and engagement with first washer member 161 that is also prevented from rotating), as first cleat rotating member 151 rotates first extending portion 141 is translated out of central bore 470 of first cleat rotating member 151.

Referring to FIG. 10, first cleat member 121 initially has height H1. In this case, the height of first cleat member 121 is determined to be the distance between distal portion 430 and bottom portion 116 of sole structure 110. After rotating first cleat rotating member 151 using screw driver 900, first extending portion 141 is extended from first cleat rotating member 151 so that first cleat member 121 is adjusted to a height H2, as seen in FIG. 11.

As seen in FIG. 11, first cleat member 121 may be configured to stretch as the height of first cleat member 121 is increased. In some embodiments, the material properties of proximal portion 432 of first cleat member 121 may be selected to provide the desired elasticity and durability for first cleat member 121.

Figure 12:
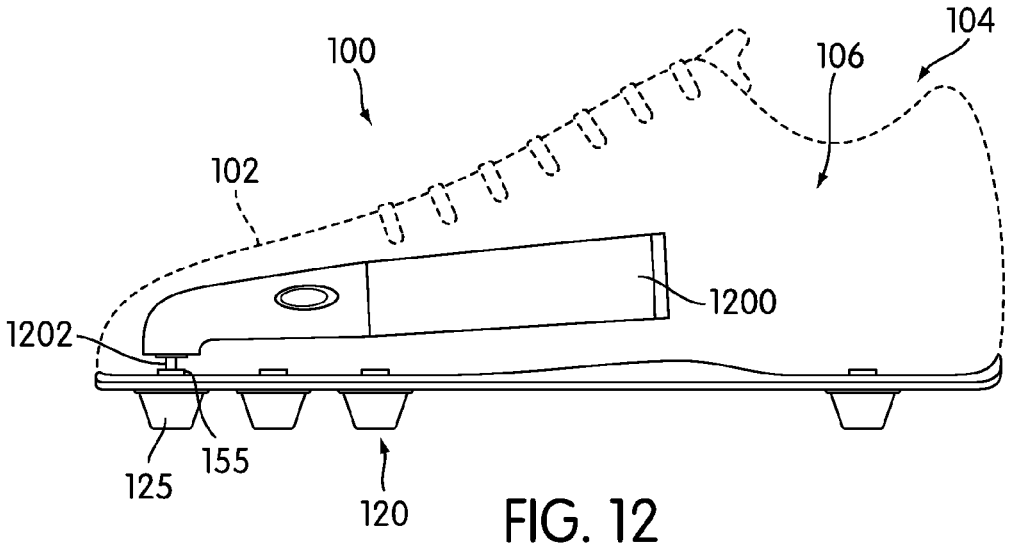
FIG. 12 is a side view of an embodiment of an article of footwear with a cleat member being adjusted using a right angle screwdriver.
Figure 13:
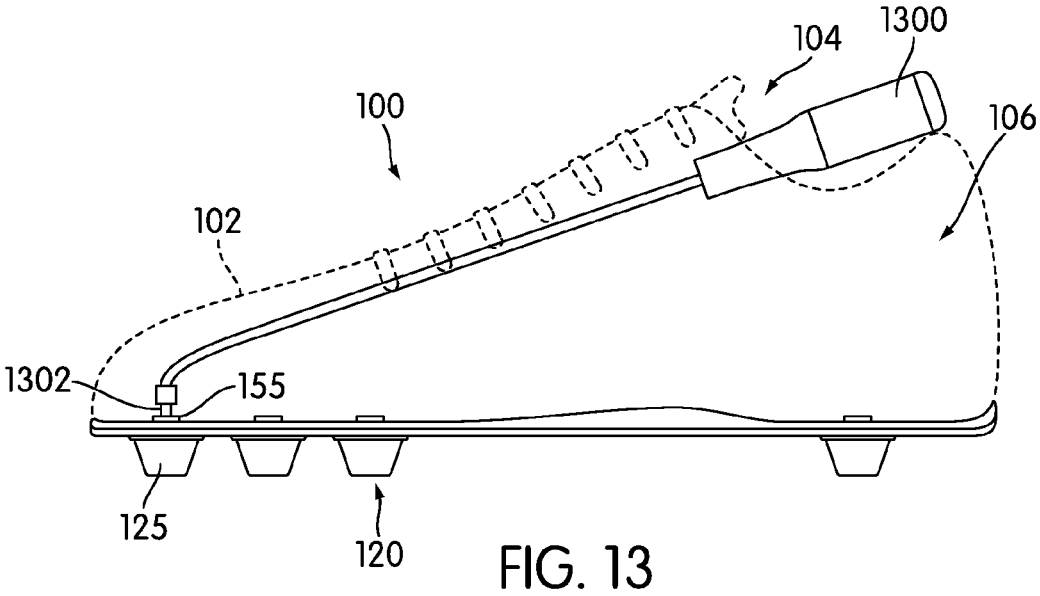
FIG. 13 is a side view of an embodiment of an article of footwear with a cleat member being adjusted using a flexible shaft screwdriver.

FIGS. 12 and 13 illustrate embodiments of methods for adjusting cleat members disposed in forefoot portion 10 of article of footwear 100. Referring to FIG. 12, right angle screwdriver 1200 may be inserted through entry hole 104 and into interior cavity 106. Driving end 1202 of right angle screwdriver 1200 can be inserted into fifth cleat rotating member 155 in order to rotate fifth cleat rotating member 155 (see FIG. 2) of fifth cleat member 125. In some cases, right angle screw driver 1200 could be a manual screwdriver. In other cases, right angle screw driver 1200 could be an automatic screwdriver. Referring now to FIG. 13, as another example of a fastening device, flexible shaft screwdriver 1300 may be inserted through entry hole 104 and into interior cavity 106. Driving end 1302 of flexible shaft screwdriver 1300 can be inserted into fifth cleat rotating member 155 in order to rotate fifth rotating member 155 (see FIG. 2) of fifth cleat member 125. It will be understood that in still other embodiments, any other types of fastening devices could be used to adjust one or more cleats of plurality of cleat members 120.

Although the current embodiment uses fastening devices that are inserted into an interior cavity of an upper to access a top portion of a sole structure, in other embodiments any other means for providing a user access to the top portion of the sole structure can be used. For example, in some other embodiments, an article could include a detachable upper. In such embodiments, a user could simply remove the upper from the sole structure to gain access to the top portion and thereby adjust the heights of one or more cleat members.

Using the configuration discussed above for article of footwear 100, the heights of each cleat member of plurality of cleat members 120 can be changed in a substantially independent manner. In other words, the height of first cleat member 121 can be adjusted substantially independently of the height of second cleat member 122. Similarly, the heights any two cleat members of plurality of cleat members 120 can be adjusted substantially independently of one another. This arrangement allows plurality of cleat members 120 to be adjusted in a manner that provides various different cleat configurations. These different cleat configurations can be adapted to increase performance on various playing surfaces or in various playing conditions. Moreover, in some cases, a cleat configuration can be adjusted to adapt to various characteristics of a user. As an example, a user that tends to lean on the lateral side of the foot may adjust the cleat members on the lateral side of article of footwear 100 to have substantially shorter heights than the cleats on the medial side of article of footwear 100. This may help maintain balanced traction on both the lateral and medial sides of article 100 for a user tending to lean on their lateral side.

FIGS. 14 through 18 illustrate embodiments of various cleat height configurations for article of footwear 100. It will be understood that these configurations are only intended to be exemplary and in other embodiments, any other combination of cleat heights for plurality of cleat members 120 could be used. For purposes of clarity, article of footwear 100 is disposed on surface 1400 in these embodiments.

Figure 14:
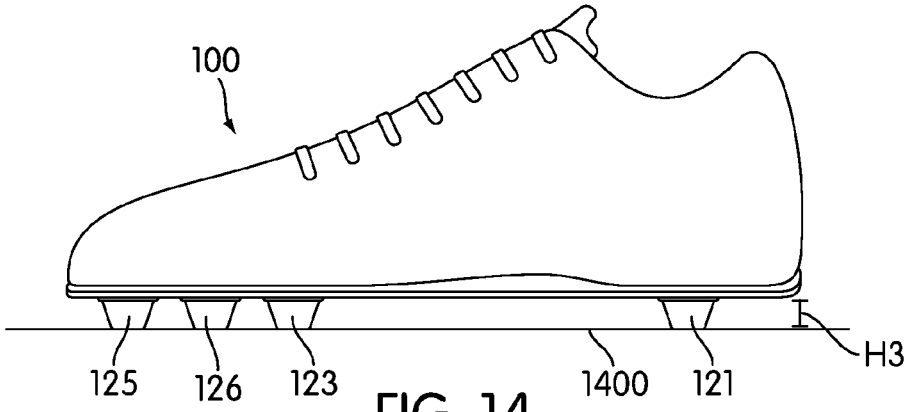
FIG. 14 is a side view of an embodiment of a cleat configuration for an article of footwear.

Referring to FIG. 14, each cleat member of plurality of cleat members 120 may have a substantially similar height H3. In this case, first cleat member 121, third cleat member 123, fifth cleat member 125 and sixth cleat member 126 are all visible as having substantially similar heights H3. Although fourth cleat member 124 and second cleat member 122 are not visible in this case, both cleat members may also be configured with height H3.

Figure 15:
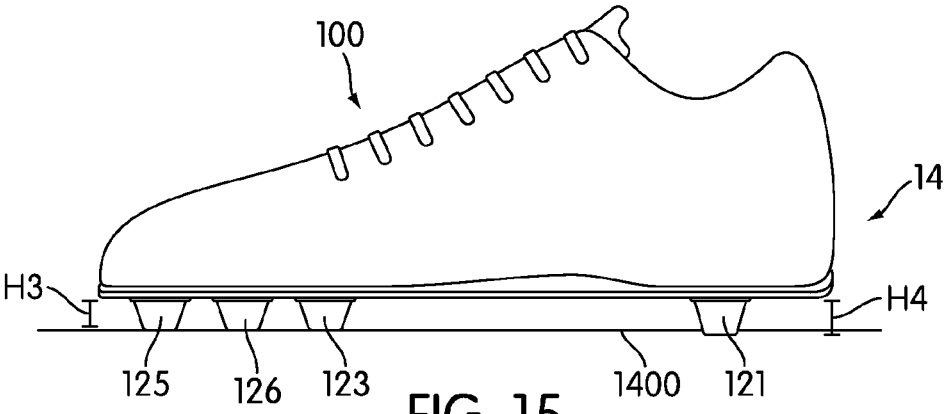
FIG. 15 is a side view of an embodiment of a cleat configuration for an article of footwear.

Referring to FIG. 15, first cleat member 121 and second cleat member 122 (not shown) may be adjusted to have height H4. In this case, height H4 may be slightly greater than height H3. Using this cleat configuration, first cleat member 121 and second cleat member 122 may provide increased traction at heel portion 14 of article 100, since first cleat member 121 and second cleat member 122 have the capability of penetrating further into surface 1400 than third cleat member 123, fourth cleat member 124 (not shown), fifth cleat member 125 and sixth cleat member 126. In some cases, this arrangement may provide a rear braking effect for article of footwear 100.

Figure 16:
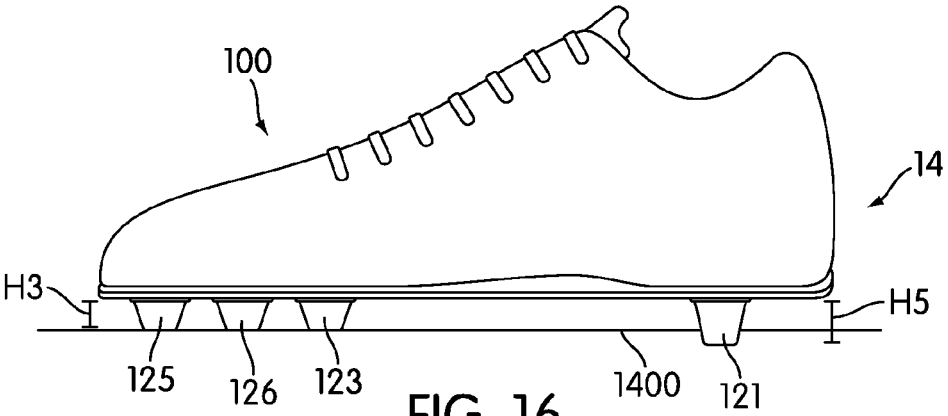
FIG. 16 is a side view of an embodiment of a cleat configuration for an article of footwear.

Referring to FIG. 16, the height of first cleat member 121 and second cleat member 122 (not shown) has further increased to height H5, which is substantially greater than height H3. This arrangement may allow for a more dramatic increase in traction at heel portion 14 of article 100.

Figure 17:
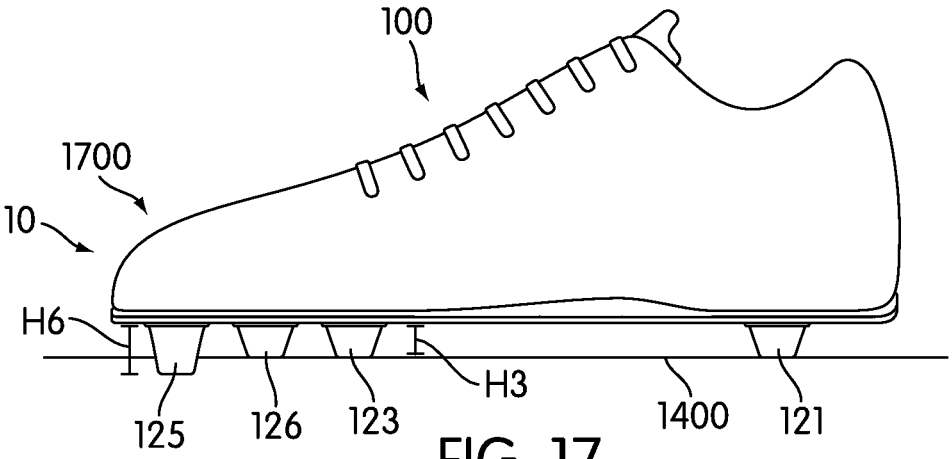
FIG. 17 is a side view of an embodiment of a cleat configuration for an article of footwear.

Referring to FIG. 17, first cleat member 121 and second cleat member 122 (not shown) have been adjusted to each have height H3. In addition, third cleat member 123, fourth cleat member 124 (not shown) and sixth cleat member 126 may also have height H3. In this case, however, fifth cleat member 125 has been adjusted to have height H6. In this embodiment, height H6 is substantially greater than height H3. With this configuration, the traction of article 100 may be maximized at toe portion 1700 of article 100. In some cases, this cleat configuration could help facilitate a user in planting forefoot portion 10 on surface 1400.

Figure 18:
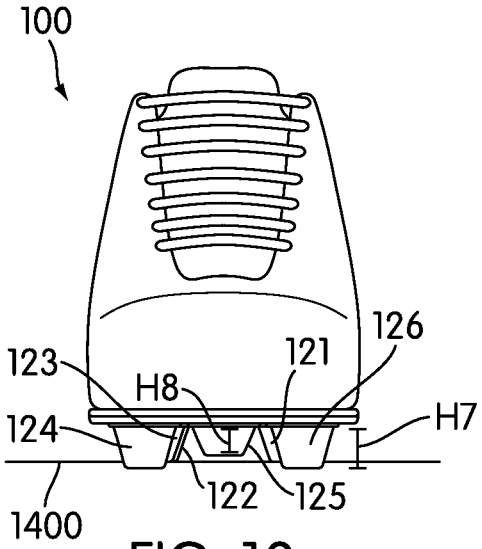
FIG. 18 is a front view of an embodiment of a cleat configuration for an article of footwear.

Referring to FIG. 18, first cleat member 121, second cleat member 122, third cleat member 123, fourth cleat member 124 and sixth cleat member 126 have all been adjusted to have height H7. In contrast, fifth cleat member 125 has been adjusted to have height H8. In this case, height H8 is substantially smaller than height H7. This arrangement may provide for a more even traction across article 100 with respect to the lateral direction.

Figure 19:
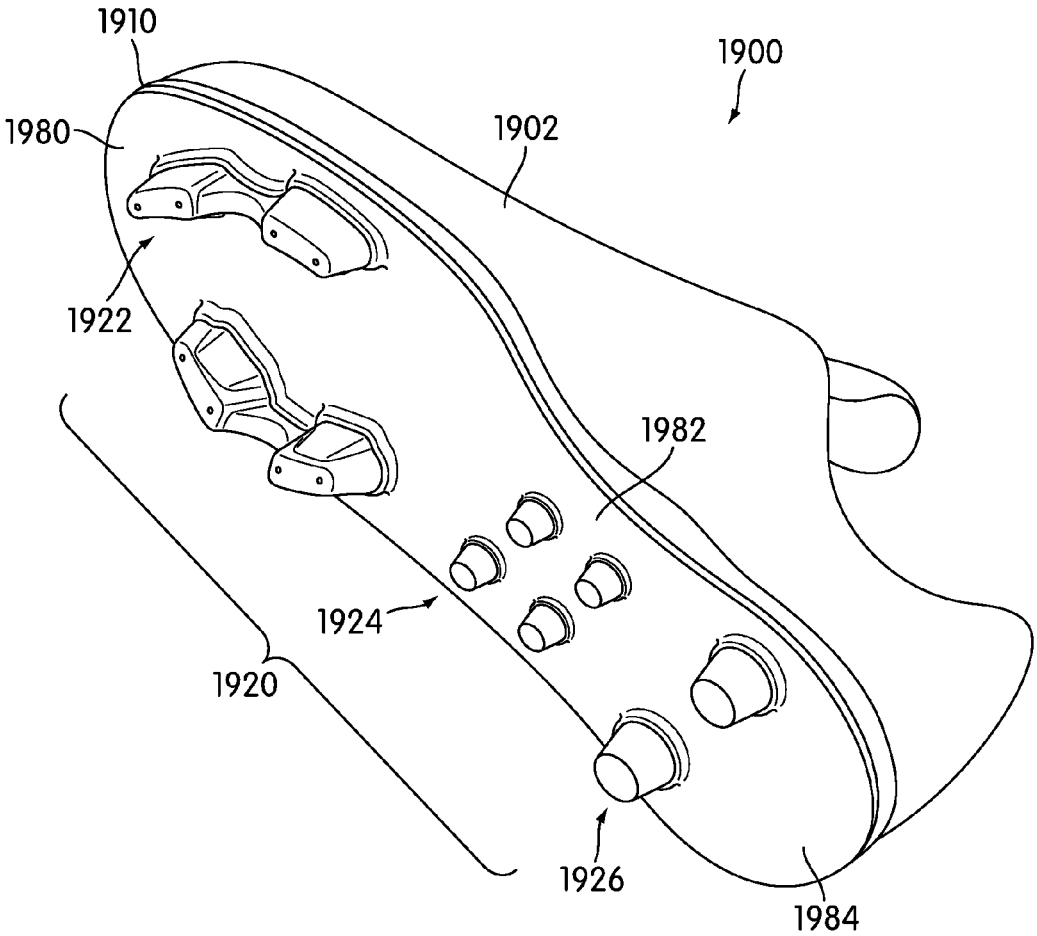
FIG. 19 is an isometric view of another embodiment of an article of footwear including a plurality of cleat members.
Figure 20:
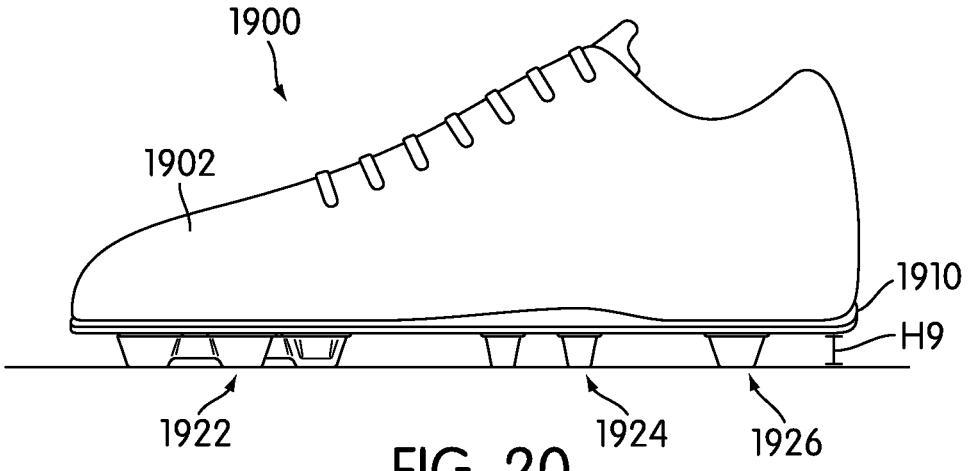
FIG. 20 is a side view of an embodiment of a cleat configuration for an article of footwear.
Figure 21:
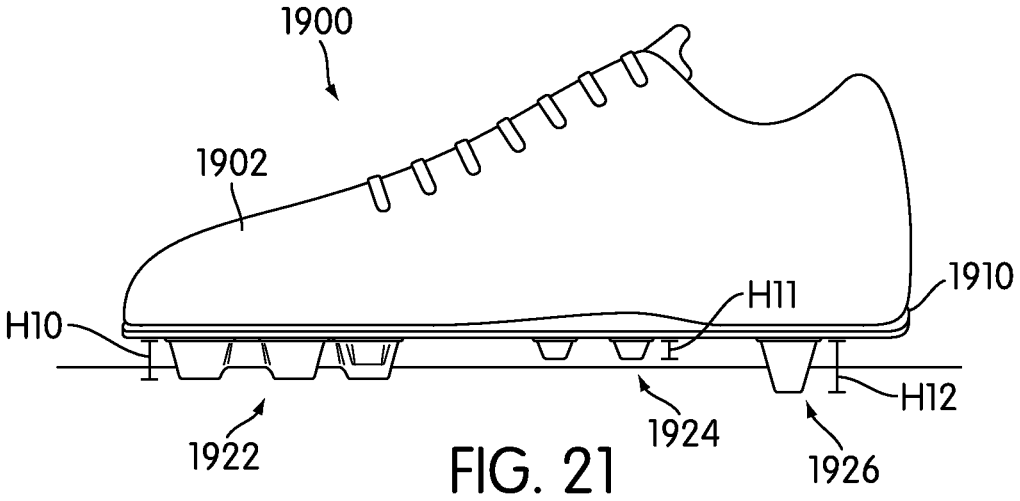
FIG. 21 is a side view of an embodiment of a cleat configuration for an article of footwear.

FIGS. 19 through 21 illustrate another embodiment of article of footwear 1900. In the previous embodiment, the cleat members of article 100 comprised substantially similar geometries and sizes. In contrast, the current embodiment includes cleat members of varying sizes and geometries.

Referring to FIG. 19, article of footwear 1900, also referred to simply as article 1900, includes upper 1902 and sole structure 1910. Upper 1902 and sole structure 1910 may be substantially similar to upper 102 and sole structure 110 of the previous embodiments. Article 1900 further includes plurality of cleat members 1920. In some embodiments, plurality of cleat members 1920 may comprise cleat members that are attached to sole structure 1910 in an adjustable way. In other words, in a similar manner to the previous embodiment, plurality of cleat members 1920 may be associated with cleat assemblies that allow for the adjustment of the heights of each cleat member.

In different embodiments, the geometries and/or sizes of different cleat members can vary. In the current embodiment, plurality of cleat members 1920 may comprise three distinct cleat member sets, including first cleat member set 1922, second cleat member set 1924 and third cleat member set 1926. First cleat member set 1922 may comprise generally elongated cleat members. In particular, first cleat member set 1922 may comprise two elongated cleat members disposed in forefoot portion 1980 of article 1900. Second cleat member set 1924 may comprise generally conical cleat members with truncated ends disposed in midfoot portion 1982 of article 1900. In particular second cleat member set 1924 may comprise four conical cleat members. Third cleat member set 1926 may also include generally conical cleat members with truncated ends disposed in heel portion 1984. In particular, third cleat member set 1926 may comprise two conical cleat members. With this arrangement, each cleat member set may provide substantially different types of traction in forefoot portion 1980, midfoot portion 1982 and heel portion 1984 of article 1900.

Although the cleat members of second cleat member set 1924 and third cleat member set 1926 have substantially similar geometries, the sizes of the cleat members of each set may vary. In this case, second cleat member set 1924 comprises cleat members of a first size and third cleat member set 1926 comprises cleat members of a second size. In an exemplary embodiment, the second size may be substantially greater than the first size. In other words, third cleat member set 1926 comprises cleat members that are substantially larger than the cleat members of second cleat member set 1924. This arrangement may provide for increased traction in heel portion 1984 over midfoot portion 1982 of article 1900.

Referring to FIG. 20, the cleat members of first cleat member set 1922, second cleat member set 1924 and third cleat member set 1926 may all initially have substantially similar heights. In this case, each cleat member has height H9. Referring to FIG. 21, the cleat members of first cleat member set 1922 have been adjusted to have height H10. Also, the cleat members of second cleat member set 1924 have been adjusted to height H11, which is substantially less than height H10. Also, the cleat members of third cleat member set 1926 have been adjusted to height H12, which is substantially greater than height H11. This arrangement allows each cleat member set to be adjusted to substantially different heights.

The arrangement discussed here provides a cleat system with traction properties that can be tuned for various different situations. By adjusting the heights of each cleat independently, different amounts and types of traction can be achieved over different regions of an article of footwear. This provides an article of footwear with increased versatility over articles where the cleat heights are fixed or where the cleat heights cannot be changed independently.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper;

a sole structure including a top portion and a bottom portion disposed distally from the top portion;

a cleat rotating member disposed within the sole structure, wherein the cleat rotating member includes a drive receiving surface and a recess;

a cleat member including an extending portion that engages the cleat rotating member and an outer peripheral portion disposed around the extending portion;

wherein the engaged extending portion and cleat rotating member define a central longitudinal axis;

wherein the cleat rotating member rotates about the central longitudinal axis and is axially fixed relative to the central longitudinal axis;

wherein the extending portion of the cleat member is rotationally fixed about the central longitudinal axis and moves axially along the central longitudinal axis relative to the axially fixed cleat rotating member;

wherein turning the cleat rotating member moves the extending portion of the cleat member axially along the central longitudinal axis relative to the axially fixed cleat rotating member to adjust a height of the cleat member with respect to the bottom portion of the sole structure;

wherein the recess of the cleat rotating member is accessible from within an interior cavity of the article of footwear through a hole on the top portion of the sole structure; and wherein the outer peripheral portion of the cleat member remains fixed relative to the bottom portion of the sole structure when the height of the cleat member is adjusted.

2. The article of footwear according to claim 1, wherein the extending portion is a bolt.

3. The article of footwear according to claim 2, wherein the bolt includes threading that is configured to engage threading in the cleat rotating member.

4. The article of footwear according to claim 1, wherein the cleat rotating member is configured to be turned using a fastening device.

5. The article of footwear according to claim 4, wherein the fastening device is a screwdriver.

6. The article of footwear according to claim 5, wherein the drive receiving surface of the cleat rotating member is disposed proximate the top portion of the sole structure, the drive receiving surface being configured to receive the screwdriver.

7. The article of footwear according to claim 1, wherein the outer peripheral portion of the cleat member is attached to the sole structure.

8. The article of footwear according to claim 1, wherein a washer member is disposed radially between the cleat member and the cleat rotating member;

wherein the washer member is fixed relative to the sole structure and rotationally fixed about the central longitudinal axis;

wherein the washer member includes a rib and the cleat member includes a notch configured to receive the rib; and wherein engagement of the rib of the washer member with the notch of the cleat member causes the outer peripheral portion of the cleat member to remain fixed relative to the bottom portion of the sole structure.

9. The article of footwear according to claim 1, wherein the cleat member is configured to stretch when the height of the cleat member is increased.

10. The article of footwear according to claim 1, wherein a washer member is disposed radially between the cleat member and the cleat rotating member;

wherein the washer member has a cylindrical base portion;

wherein the cleat member has an outer conical surface; and wherein an outer cleat portion of the cleat member fills the space between the cylindrical base portion of the washer member and the outer conical surface of the cleat member.

11. An article of footwear, comprising:

an upper including an interior cavity for receiving a foot;

a sole structure including a top portion and a bottom portion disposed distally from the top portion, the top portion being associated with the interior cavity of the upper;

the sole structure including a first cleat member having an adjustable height, the first cleat member including a first proximal portion disposed adjacent to and extending from the bottom portion of the sole structure to a first distal portion spaced apart from the bottom portion of the sole structure;

the sole structure including a second cleat member having an adjustable height, the second cleat member including a second proximal portion disposed adjacent to and extending from the bottom portion of the sole structure to a second distal portion spaced apart from the bottom portion of the sole structure;

wherein the height of the first cleat member and the height of the second cleat member are configured to be adjusted substantially independently;

wherein the height of the first cleat member is adjustable from within the interior cavity and wherein the height of the second cleat member is adjustable from within the interior cavity;

wherein a distance between the first distal portion of the first cleat member and the bottom portion of the sole structure is configured to change as the height of the first cleat member is adjusted;

wherein a distance between the second distal portion of the second cleat member and the bottom portion of the sole structure is configured to change as the height of the second cleat member is adjusted;

wherein the first proximal portion remains fixed in position relative to the bottom portion of the sole structure as the height of the first cleat member is adjusted and wherein the second proximal portion remains fixed in position relative to the bottom portion of the sole structure as the height of the second cleat member is adjusted; and wherein the first cleat member comprises:

a cleat rotating member disposed in the first proximal portion of the first cleat member;

a cleat member that engages the cleat rotating member;

wherein the engaged cleat rotating member and cleat member define a central longitudinal axis;

wherein the cleat rotating member rotates about the central longitudinal axis and is axially fixed relative to the central longitudinal axis and the sole structure;

wherein the cleat member is rotationally fixed about the central longitudinal axis and moves axially along the central longitudinal axis relative to the axially fixed cleat rotating member and to the sole structure; and wherein rotating the cleat rotating member moves the cleat member axially along the central longitudinal axis relative to the axially fixed cleat rotating member and to the sole structure.

12. The article of footwear according to claim 11, wherein the first cleat member is disposed on a forefoot portion of the sole structure and wherein the second cleat member is disposed on a heel portion of the sole structure.

13. The article of footwear according to claim 11, wherein the first cleat member is disposed on a forefoot portion of the sole structure and wherein the second cleat member is disposed on a midfoot portion of the sole structure.

14. The article of footwear according to claim 11, wherein the first cleat member is disposed on a midfoot portion of the sole structure and wherein the second cleat member is disposed on a heel portion of the sole structure.

15. The article of footwear according to claim 11, wherein the first cleat member has a first size and wherein the second cleat member has a second size that is substantially different from the first size.

16. The article of footwear according to claim 11, wherein the sole structure includes three or more cleat members with adjustable heights.

17. The article of footwear according to claim 11, wherein the first cleat member and the second cleat member are configured to stretch.

18. The article of footwear according to claim 11, wherein the first proximal portion of the first cleat member includes a first outer peripheral portion that is attached to the sole structure; and wherein the second proximal portion of the second cleat member includes a second outer peripheral portion that is attached to the sole structure.

19. An article of footwear, comprising:

an upper;

a sole structure including a top portion and a bottom portion disposed distally from the top portion;

a cleat rotating member disposed within the sole structure;

wherein the cleat rotating member has a drive receiving surface and a recess;

a cleat member including an outer cleat portion and an extending portion, the extending portion extending away from the bottom portion of the sole structure and being configured to engage the cleat rotating member along a central longitudinal axis;

wherein the cleat rotating member rotates about the central longitudinal axis and is axially fixed relative to the central longitudinal axis;

a washer member disposed radially between the cleat rotating member and the cleat member, the washer member including a rib and being fixed relative to the sole structure and rotationally fixed about the central longitudinal axis;

the outer cleat portion of the cleat member including a notch that receives the rib of the washer member such that the cleat member is rotationally fixed about the central longitudinal axis;

wherein the cleat member moves axially along the central longitudinal axis relative to the axially fixed cleat rotating member and to the sole structure;

wherein turning the cleat rotating member moves the cleat member axially along the central longitudinal axis relative to the axially fixed cleat rotating member to adjust a height of the cleat member with respect to the bottom portion;

wherein the recess of the cleat rotating member is accessible from within an interior cavity of the article of footwear through a hole on the top portion of the sole structure; and wherein the outer cleat portion of the cleat member is prevented from rotating by the washer member when the cleat rotating member is turned to adjust the height of the cleat member.

20. The article of footwear according to claim 19, wherein the outer cleat portion includes a proximal portion and a distal portion and wherein an outer peripheral portion is associated with the proximal portion.

21. The article of footwear according to claim 20, wherein the outer peripheral portion is attached to the sole structure to prevent rotation of the outer cleat portion.

22. The article of footwear according to claim 21, wherein the outer peripheral portion extends outwardly from a base of the proximal portion;

wherein the sole structure includes a first proximal layer and a second distal layer; and wherein the outer peripheral portion is disposed between and attached to the first proximal layer and the second distal layer.

23. The article of footwear according to claim 19, wherein the proximal portion is substantially less rigid than the distal portion.

24. The article of footwear according to claim 23, wherein the proximal portion is configured to stretch when the height of the cleat member is adjusted.

25. The article of footwear according to claim 19, wherein the washer member includes a plurality of ribs extending longitudinally away from the bottom portion of the sole structure;

wherein the outer cleat portion includes a plurality of notches extending longitudinally away from the bottom portion of the sole structure; and wherein the washer member is configured to prevent rotation of the outer cleat portion by engagement of the plurality of ribs of the washer member with the plurality of notches of the outer cleat portion.

26. The article of footwear according to claim 19, wherein the cleat rotating member includes an end portion disposed through a hole in the top portion of the sole structure.

27. The article of footwear according to claim 19, wherein the washer member includes a flange portion.

28. The article of footwear according to claim 27, wherein the flange portion has a clover shape;

wherein the flange portion is configured to fit within a recess in the sole structure;

wherein the recess has a shape corresponding to the clover shape of the flange portion; and wherein engagement of the flange portion and the recess prevents rotation of the washer member.

* * * * *